US006688238B1

(12) United States Patent
Alexiou

(10) Patent No.: US 6,688,238 B1
(45) Date of Patent: Feb. 10, 2004

(54) SHOWER ACCESSORY ORGANIZING SYSTEM

(76) Inventor: Chrisafina Alexiou, 2015 Lawrence Ave E # 119, Toronto, Ont (CA), M1R 5H2

( * ) Notice: Subject to any disclaimer, the term of this patent is extended or adjusted under 35 U.S.C. 154(b) by 0 days.

(21) Appl. No.: 10/215,640

(22) Filed: Aug. 9, 2002

(51) Int. Cl.[7] ..... A47B 23/00
(52) U.S. Cl. ..... 108/42; 211/86; D6/525
(58) Field of Search ..... 108/42, 48, 96, 108/97, 95, 93, 47, 147.12, 147.11, 108; 248/610, 128.8, 161, 157; 211/90, 90.02, 119.009, 119.011, 120, 119.03; 4/605

(56) References Cited

U.S. PATENT DOCUMENTS

| | | | | |
|---|---|---|---|---|
| 475,149 | A | | 5/1892 | Pearson |
| 3,035,708 | A | | 5/1962 | Freeman |
| 3,221,678 | A | * | 12/1965 | Doherty ..... 248/230.1 |
| 4,129,080 | A | | 12/1978 | Vall |
| 5,255,401 | A | * | 10/1993 | Sambrookes et al. ..... 4/605 |
| D394,968 | S | * | 6/1998 | Gottwald ..... D6/540 |
| 5,934,634 | A | | 8/1999 | Lindblom |
| D421,867 | S | | 3/2000 | Carville et al. |
| D429,934 | S | * | 8/2000 | Hofman ..... D6/525 |
| 6,443,319 | B1 | * | 9/2002 | Sander ..... 211/187 |
| 6,554,235 | B1 | * | 4/2003 | Fortier ..... 248/122.1 |
| D475,229 | S | * | 6/2003 | Suero ..... D6/525 |

FOREIGN PATENT DOCUMENTS

| | | |
|---|---|---|
| JP | 5-331889 | * 12/1993 |

* cited by examiner

*Primary Examiner*—Jose V. Chen

(57) ABSTRACT

A shower accessory organizing system for providing a neat, organized, out-of-the-way storage of accessories while still keeping them readily accessible to the user. The shower accessory organizing system includes a vertical support portion that has a first end and a second end. The vertical support portion is extendable between a pair of horizontal support surfaces such as a floor and a ceiling. At least one shelf member is couplable to the vertical support portion. The shelf member has a horizontal support surface for holding a plurality of shower accessories.

10 Claims, 2 Drawing Sheets

SHOWER ACCESSORY ORGANIZING SYSTEM

BACKGROUND OF THE INVENTION

1. Field of the Invention

The present invention relates to organizing systems and more particularly pertains to a new shower accessory organizing system for providing a neat, organized, out-of-the-way storage of accessories while still keeping them readily accessible to the user.

2. Description of the Prior Art

The use of organizing systems is known in the prior art. U.S. Pat. No. 3,035,708 describes an adjustable stanchion for use in holding towel rings, clothes hooks and other accessories. Another type of organizing system is U.S. Pat. No. Des. 429,934 describing an ornamental design for a pole caddy. U.S. Pat. No. Des. 421,867 describes an ornamental design for a shelving assembly. U.S. Pat. No. 4,129,080 describes a shelf support device which can be wall hung, ceiling hung or free standing. U.S. Pat. No. 5,934,634 describes a carrier and releasable holder for supporting goods anywhere along a vertical post. U.S. Pat. No. 475,149 describes a stovepipe attachment.

SUMMARY OF THE INVENTION

The object of the present invention is to provide a new shower accessory organizing system that would provide storage for all bathroom products in one convenient area of a bathroom.

Another object of the present invention is to provide a new shower accessory organizing system that would be ideal for use in homes with small bathrooms or those with limited storage space.

To this end, the present invention generally comprises a vertical support portion that has a first end and a second end. The vertical support portion is extendable between a pair of horizontal support surfaces such as a floor and a ceiling. At least one shelf member is couplable to the vertical support portion. The shelf member has a horizontal support surface for holding a plurality of shower accessories.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
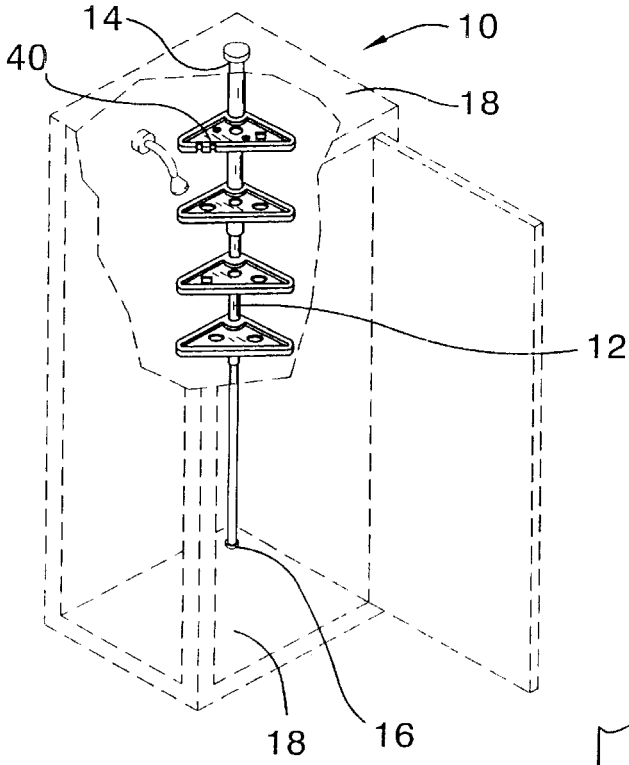
FIG. 1 is a in-use view of a new shower accessory organizing system according to the present invention.
Figure 2:
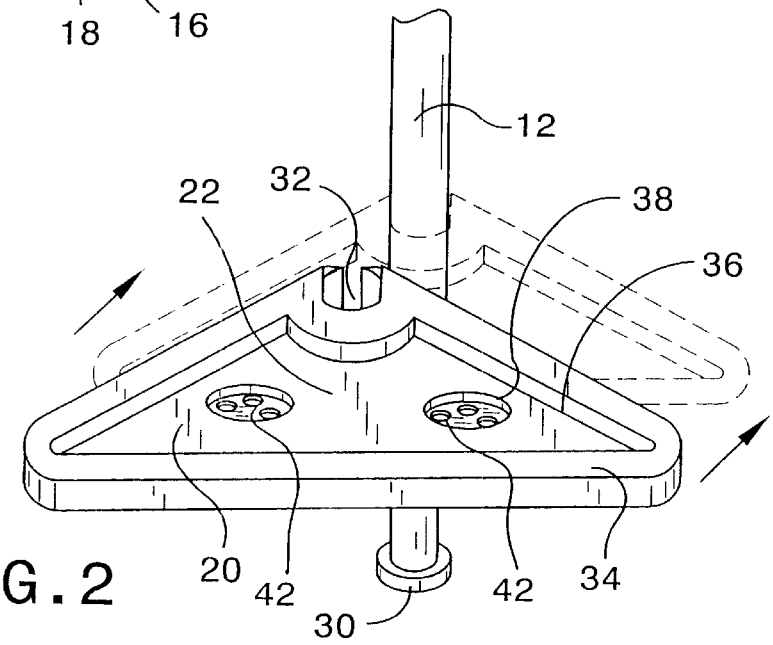
FIG. 2 is a perspective view of the present invention.
Figure 4:
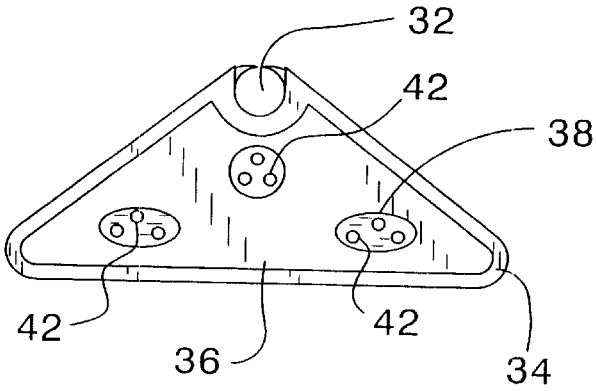
FIG. 4 is a cross-sectional view of the present invention.
Figure 3:
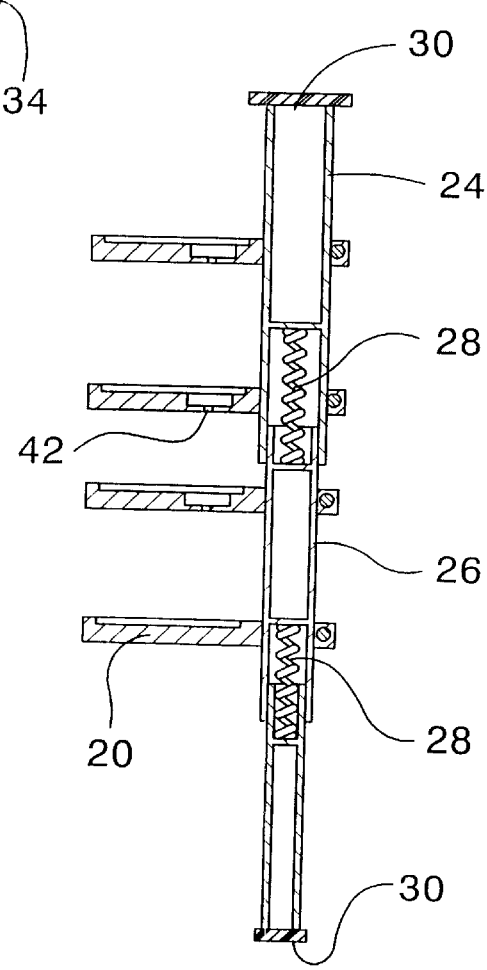
FIG. 3 is a top view of the present invention.

With reference now to the drawings, and in particular to FIGS. 1 through 4 thereof, a new shower accessory organizing system embodying the principles and concepts of the present invention and generally designated by the reference numeral 10 will be described.

As best illustrated in FIGS. 1 through 4, the shower accessory organizing system 10 generally comprises a vertical support portion 12 that has a first end 14 and a second end 16. The vertical support portion 12 is extendable between a pair of horizontal support surfaces 18 such as a floor and a ceiling. At least one shelf member 20 is couplable to the vertical support portion 12. The shelf member 20 has a horizontal support surface 22 for holding a plurality of shower accessories.

The vertical support portion 12 is telescopic such that a length of the vertical support portion 12 is adjustable. The vertical support portion 12 has a first pole section 24 and a second pole section 26. The first pole section 24 slideably engages the second pole section 26 such that the length of the vertical support portion 12 is adjustable.

A biasing means 28 is contained substantially in the second pole section 26 and is held in a substantially static position relative to the first pole section 24. An expansive force is applied to a pair of horizontal support surfaces 18 for maintaining the vertical support portion 12 in a static position relative to the pair of horizontal support surfaces 18.

A plurality of pad members 30 is positionable on the first end 14 and the second end 16 of the vertical support portion 12. The pad members 30 is for minimizing slippage of the vertical support portion 12 on the horizontal support surfaces 18.

The shelf member 20 has an arcuate clip portion 32. The arcuate clip portion 32 is for fastening the shelf member 20 to the vertical support portion 12. The shelf member 20 has a lip portion 34 for extending around the perimeter edge 36 of the shelf member 20 for preventing the shower accessories from sliding off the shelf member 20. At least one recessed portion 38 of the shelf member 20 is designed for facilitating the organization and placement of the shower accessories. A plurality of slots 40 extends thru the horizontal support surface 22. The slots 40 are for holding the shower accessories. The recessed portion 38 further comprises a plurality of apertures 42 extending therethrough. The apertures 42 are for draining the recessed portion 38.

In use, a user would position the vertical support portion between a pair of horizontal support surfaces. A series of shelf members could be snapped into place on the vertical support portion. A user could then arrange accessories on the shelf members in an organized manner.

In a preferred embodiment each of the recessed portions has a plurality of apertures for draining water from the recessed portion.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An shower accessory organizing system for use between a pair of horizontal support surfaces, comprising:

a vertical support portion having a first end and a second end, said vertical support portion being extendable between a pair of horizontal support surfaces such as a floor and a ceiling;

at least one shelf member being couplable to said vertical support portion, said shelf member having a horizontal support surface for holding a plurality of shower accessories;

wherein said shelf member has an arcuate clip portion, said arcuate clip portion being for fastening said shelf member to said vertical support portion; and said shelf member comprising a pair of finger portions extending into said arcuate clip portion of said shelf member, one of said finger portions being positioned in a spaced relationship to the other one of said finger portions such that said finger portions separate to allow said vertical support portion to slide into said arcuate clip portion of said shelf member when said shelf member is coupled to said vertical support portion, said finger portions engaging said vertical support portion to inhibit said vertical support portion being inadvertently removed from said arcuate clip portion of said shelf member when said shelf member is coupled to said vertical support portion.

2. The system of claim 1, wherein said vertical support portion is telescopic such that a length of said vertical support portion is adjustable.

3. The system of claim 2, wherein said vertical support portion has a first pole section and a second pole section, said first pole section slideably engages said second pole section such that the length of said vertical support portion is adjustable.

4. The system of claim 3, wherein a biasing means is contained substantially in said second pole section being held in a substantially static position relative to said first pole section whereby an expansive force is applied to a pair of horizontal support surfaces maintaining said vertical support portion in a static position relative to said pair of horizontal support surfaces.

5. The system of claim 1, wherein said vertical support portion has a plurality of pad members positionable on said first end second and said second end of said vertical support portion, said pad members being for minimizing slippage of said vertical support portion on said horizontal support surfaces.

6. The system of claim 1, wherein said shelf member has an lip portion for extending around the perimeter edge of said shelf member for preventing said shower accessories from sliding off the shelf member.

7. The system of claim 1, wherein said shelf member comprises at least one recessed portion, said recessed portion of said shelf member being adapted for facilitating the organization and placement of the shower accessories.

8. The system of claim 7, wherein said recessed portion further comprises a plurality of apertures extending therethrough, said apertures being for draining said recessed portion.

9. The system of claim 1, further comprising a plurality of slots extending thru said horizontal support surface, said slots are for holding the shower accessories.

10. An shower accessory organizing system for use between a pair of horizontal support surfaces, comprising:

a vertical support portion having a first end and a second end, said vertical support portion being extendable between a pair of horizontal support surfaces such as a floor and a ceiling; and at least one shelf member being couplable to said vertical support portion, said shelf member having a horizontal support surface for holding a plurality of shower accessories;

wherein said vertical support portion is telescopic such that a length of said vertical support portion is adjustable;

wherein a first pole section and a second pole section, said first pole section slideably engages said second pole section such that the length of said vertical support portion is adjustable;

wherein a biasing means is contained substantially in said second pole section being held in a substantially static position relative to said first pole section whereby an expansive force is applied to a pair of horizontal support surfaces maintaining said vertical support portion in a static position relative to said pair of horizontal support surfaces;

wherein a plurality of pad members positionable on said first end second and said second end of said vertical support portion, said pad members being for minimizing slippage of said vertical support portion on said horizontal support surfaces;

wherein said shelf member has an arcuate clip portion, said arcuate clip portion being for fastening said shelf member to said vertical support portion;

said shelf member comprising a pair of finger portions extending into said arcuate clip portion of said shelf member, one of said finger portions being positioned in a spaced relationship to the other one of said finger portions such that said finger portions separate to allow said vertical support portion to slide into said arcuate clip portion of said shelf member when said shelf member is coupled to said vertical support portion, said finger portions engaging said vertical support portion to inhibit said vertical support portion being inadvertently removed from said arcuate clip portion of said shelf member when said shelf member is coupled to said vertical support portion;

wherein said shelf member has an lip portion for extending around the perimeter edge of said shelf member for preventing said shower accessories from sliding off the shelf member;

wherein at least one recessed portion, said recessed portion of said shelf member being adapted for facilitating the organization and placement of the shower accessories; and wherein a plurality of slots extending thru said horizontal support surface, said slots are for holding the shower accessories.

* * * * *